United States Patent [19]

Mathers

[11] Patent Number: 4,617,054

[45] Date of Patent: Oct. 14, 1986

[54] PRODUCTION OF METAL STRIP

[75] Inventor: Roy Mathers, Clywd, Wales

[73] Assignee: Mixalloy Limited, Clywd, Wales

[21] Appl. No.: 763,543

[22] Filed: Aug. 7, 1985

[30] Foreign Application Priority Data

Aug. 10, 1984 [GB] United Kingdom ..... 8420327

[51] Int. Cl.[4] ..... B22F 3/00

[52] U.S. Cl. ..... 75/246; 419/3; 419/28; 419/36; 419/65; 419/69; 419/40; 75/228

[58] Field of Search ..... 419/3, 8, 9, 40, 28, 419/36, 65, 69; 75/228, 246

[56] References Cited

U.S. PATENT DOCUMENTS

| | | | |
|---|---|---|---|
| 3,323,879 | 6/1967 | Kerstetter et al. | 29/182 |
| 3,335,002 | 8/1967 | Clarke | 75/208 |
| 3,487,521 | 1/1970 | Clarke | 29/182.5 |
| 3,653,884 | 4/1972 | Davies et al. | 75/214 |
| 3,720,511 | 3/1973 | Davies et al. | 75/214 |
| 3,989,863 | 11/1976 | Jackson et al. | 419/40 |
| 4,207,120 | 6/1980 | Armstrong et al. | 419/3 |
| 4,491,559 | 1/1985 | Grab et al. | 419/40 |

FOREIGN PATENT DOCUMENTS

| | | |
|---|---|---|
| 1163766 | 9/1969 | United Kingdom . |
| 1212681 | 11/1970 | United Kingdom . |
| 1257032 | 12/1971 | United Kingdom . |
| 1360486 | 7/1974 | United Kingdom . |

*Primary Examiner*—Stephen J. Lechert, Jr.
*Attorney, Agent, or Firm*—Kinney & Lange

[57] ABSTRACT

A process for producing strip from particulate metallic material in which a slurry comprising a suspension of particulate metallic material in a solution of water containing a film forming binder material is deposited as a coating onto a support surface and is heated to gel the binder and to dry the slurry coating, the dried strip subsequently being removed from the support surface and rolled to effect compaction thereof. The ratio of particulate metallic material to water content of the slurry lies within the range 3.4:1 and 4.2:1 to ensure good flowability of the slurry coating and to produce the required flat profile in the rolled strip.

9 Claims, 1 Drawing Figure

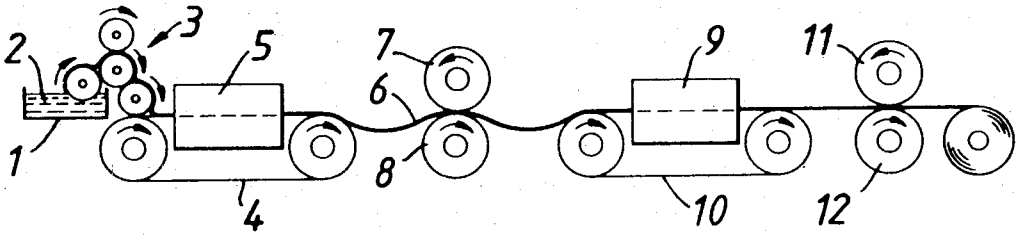
1
2
3
4
5
6
7
8
9
10
11
12

PRODUCTION OF METAL STRIP

BACKGROUND OF THE INVENTION

This invention relates to the production of strip and sheet (hereinafter referred to simply as 'strip') from particulate material. More especially, the invention relates to the production of strip from particulate metallic material.

A process for the production of strip from metal powder is known in which a suspension of powdered metal in a solution of a film-forming binder material in water is coated in the form of a slurry onto a support surface, dried, removed from the support surface, rolled and sintered to produce the metal strip product.

Operating this process has identified the need to control closely the ratio of metal powder to water present in the slurry coating to be applied to the support surface. Hitherto, it was considered necessary merely to ensure good flowability of the slurry coating; thus, metal powder to water ratios previously employed have been in the order of 3:1.

SUMMARY OF THE INVENTION

It has now been found that the use of such conventional ratios can adversely affect the profile of the strip produced from certain materials.

According to the present invention in one aspect, there is provided a process for producing strip from particulate metallic material which comprises forming a slurry comprising a suspension of particulate metallic material in a solution of water containing a film forming binder material, the ratio of particulate metallic material to water of the slurry lying in the range of 3.4:1 and 4.2:1, depositing a coating of the slurry onto a support surface, heating the slurry coating to gel the film forming binder and to dry the slurry coating, removing the dried slurry coating from the support surface in the form of a self-supporting green strip and rolling the strip to effect compaction thereof. For pre-alloyed and mixed elemental powders containing nickel, the ratio of metallic powder to water preferably lies in the range 3.85:1 and 4.20:1; for pre-alloyed and mixed elemental powders containing cobalt, the ratio preferably lies in the range 3.40:1 and 3.60:1; and for elemental and mixed elemental powders containing iron, the range preferably lies in the range 3.60:1 and 3.85:1.

The film forming binder material preferably comprises a cellulose derivative such as methyl cellulose.

According to the present invention in another aspect, there is provided strip produced by the process recited in the preceding paragraph.

BRIEF DESCRIPTION OF THE DRAWING

The invention will now be described by way of example with reference to the accompanying diagrammatic drawing in which the sole FIGURE illustrates apparatus for carrying out a process in accordance with the present invention.

DETAILED DESCRIPTION OF THE PREFERRED EMBODIMENTS

As illustrated in the drawing, a reservoir 1 contains a slurry 2 of a suspension of metal powder in a solution of water containing quantities of film-forming binder comprising a cellulose derivative and a plasticiser. Typically the binder comprises methyl cellulose and the plasticiser comprises polyethylene glycol or glycerol. A train of rollers 3 co-operate uniformly to deposit a coating of the slurry to a selected thickness and width and of the required consistency and viscosity onto a belt 4 for transport through a drying oven 5 which is effective initially to raise the temperature of the deposited slurry coating to above 40° C. to induce gelling of the methyl cellulose to form a film and subsequently to drive water from the gelled slurry. The gelled and dried slurry film emerges as a flexible and self-supporting strip 6 which can be continuously peeled off from the polished surface of the belt 4.

The edges of the strip may be trimmed by slitting either between two drying stations or as the strip leaves the oven. Trimming at this stage has the advantage that the edges of the slit strip are crack-free. The trimmed edges may be recycled to the metal powder feed.

The dried strip is sequentially fed between a pair of contra-rotating rolls, 7, 8 to effect compaction thereof and through a sinter furnace 9 to form a sintered strip product. The atmosphere existing within the furnace 9 is normally a reducing atmosphere of, for example, hydrogen and the strip may be carried through the furnace on an endless belt 10. Alternatively, the strip may be supported on a gaseous cushion as it travels through the furnace 9. Generally the tension applied to the strip during sintering is minimised through suitable control of the strip transport operations. In some instances, however, a degree of tension may be desirable to enable certain strips to expand during sintering. On leaving the furnace 9 the strip may be passed between further compaction rolls 11, 12 and re-sintered to produce strip which is fully dense and has physical properties equivalent to strip made by more conventional routes.

Dependent upon requirements and specifications, the strip may be subjected to further heat treatments, reductions using rolling lubricants, to achieve for example, a 30% to 50% reduction in thickness and/or planishing to improve the surface finish of the strip product. If the strip is required in the soft condition, a final anneal may be carried out.

In operation of the process described, it has been found that the ratio of metal powder to water contained in the slurry is critical in order to achieve the dual requirements of adequate flowability during deposition onto the belt 4 and uniformity and stability of deposition to produce in the final product the required flat profile.

In particular, if the ratio of powder to water is above a certain level, the viscosity of the slurry is such that a uniform coating of the slurry cannot readily be applied onto the belt 4.

Contrarywise, if the ratio of powder to water is below a certain level, the slightly convex cross-sectional profile required prior to initial compaction cannot be retained with the result that the final strip profile is other than uniform.

Whereas the required ratio varies between slurries containing different metal powders, the broadest permissable range of such ratios to meet the above mentioned requirements has been found to lie within the range 3.4:1 and 4.2:1.

Typical examples of slurry mixes in accordance with the invention are given in Table 1 below:

TABLE 1

| Powder | Powder/water ratio | % Powder in mix (excl. additions) |
|---|---|---|
| 80/20 Ni/Cr | 4.17:1 | 81 |
| Pure Fe | 3.60:1 | 78–79 |
| | 3.67:1 | |
| 95% Co/5% Fe (mixed elemental powders) | 3.40:1 | |
| 94/6 Co/Fe (prealloyed powder) | | 77–78 |
| 36% Ni/65% Fe (mixed elemental powders) | 3.85:1 | 79 |

In one typical example of a process in accordance with the present invention, a slurry was formed from 79.3% by weight 80/20 nickel/chrome powder of mean particle size 75 m, 0.7% methyl cellulose binder, 0.2% polyethylene glycol, and 19.8% water. The viscosity of the slurry was of the order of 25,000 centi poises. Where recycled metal powder is employed, additional cellulose is required due to cellulose degradation.

The slurry was processed by the method described above to produce, following compaction and sintering, a strip having a final gauge of approximately 0.01".

I claim:

1. A process for producing strip from particulate metallic material which comprises forming a slurry comprising a suspension of particulate metallic material in a solution of water containing a film forming binder material, a ratio by weight of particulate metallic material to water of the slurry lying in a range of 3.4:1 and 4.2:1, depositing a coating of the slurry onto a support surface, removing the slurry coating after drying from the support surface in a form of a self-supporting green strip, and rolling the strip to effect compaction thereof.

2. A process as claimed in claim 1 wherein the particulate metallic material is a nickel-containing metallic powder and wherein the ratio of this metallic powder to water content of the slurry lies in the range 3.85:1 and 4.20:1.

3. A process as claimed in claim 2 wherein the particulate metallic material comprises a pre-alloyed nickel chrome powder containing approximately 80% nickel and 20% chromium, the powder to water ratio being of the order of 4.17:1.

4. A process as claimed in claim 1 wherein the particulate metallic material is a cobalt-containing metallic powder and wherein the ratio of this metallic powder to water content of the slurry lies in the range 3.40:1 and 3.60:1.

5. A process as claimed in claim 4 wherein the particulate metallic material comprises a pre-alloyed cobalt/iron powder.

6. A process as claimed in claim 1 wherein the prticulate metallic material consists of pure iron powder and wherein the ratio of this powder to water content of the slurry is of the order of 3.60:1.

7. A process as claimed in claim 1 wherein material trimmed from the roll compacted strip is recycled for re-use in the process.

8. Metal strip produced by a process as claimed in claim 1.

9. A process as claimed in claim 4 wherein the particulate metallic material comprises a mixture of elemental cobalt and iron powders.

* * * * *